United States Patent [19]

Halvorsen et al.

[11] Patent Number: 4,562,698

[45] Date of Patent: Jan. 7, 1986

[54] VARIABLE AREA MEANS FOR AIR SYSTEMS OF AIR BLAST TYPE FUEL NOZZLE ASSEMBLIES

[75] Inventors: Robert M. Halvorsen; William F. Helmrich, both of Birmingham, Mich.

[73] Assignee: Ex-Cell-O Corporation, Troy, Mich.

[21] Appl. No.: 542,336

[22] Filed: Oct. 17, 1983

Related U.S. Application Data

[63] Continuation of Ser. No. 212,281, Dec. 2, 1980, abandoned.

[51] Int. Cl.[4] ..... F02C 7/22; F02M 23/02

[52] U.S. Cl. ..... 60/740; 60/742; 239/412

[58] Field of Search ..... 60/740, 742, 39.23, 60/39.29; 239/412, 414, 416

[56] References Cited

U.S. PATENT DOCUMENTS

| | | | |
|---|---|---|---|
| 862,867 | 8/1907 | Eggleston | 417/390 |
| 2,655,787 | 10/1953 | Brown | 60/39.23 |
| 3,028,102 | 4/1962 | Davies et al. | 239/414 |
| 3,456,882 | 7/1969 | Walker | 239/412 |
| 3,684,186 | 8/1972 | Helmrich | 60/742 |
| 3,728,859 | 4/1973 | Seiler | 60/39.23 |
| 3,958,416 | 5/1976 | Hammond, Jr. et al. | 60/737 |
| 3,978,664 | 9/1976 | Parker et al. | 60/751 |
| 4,265,085 | 5/1981 | Fox et al. | 60/742 |

FOREIGN PATENT DOCUMENTS

| | | | |
|---|---|---|---|
| 952857 | 11/1956 | Fed. Rep. of Germany . | |
| 965152 | 7/1964 | United Kingdom | 60/39.23 |

*Primary Examiner*—Carlton R. Croyle
*Assistant Examiner*—Jeffrey A. Simenauer
*Attorney, Agent, or Firm*—Edward J. Timmer

[57] ABSTRACT

A variable area air system means for air blast type fuel nozzles for use in gas turbine engines wherein fuel/air ratios are controlled for the purpose of controlling engine emission products to meet mandated emission standards over a wide range of engine operating conditions. The variable area air metering means is connected with a pressure responsive actuating means for controlling the air flow in single fuel system and dual fuel system air blast type fuel nozzle and support assemblies used in gas turbine engines.

16 Claims, 8 Drawing Figures

VARIABLE AREA MEANS FOR AIR SYSTEMS OF AIR BLAST TYPE FUEL NOZZLE ASSEMBLIES

This application is a continuation of application Ser. No. 212,281, filed 12-2-80, now abandoned.

BACKGROUND AND SUMMARY OF THE INVENTION

This invention relates to a variable area means for air systems of air blast type fuel nozzle. The variable area means is intended for use in the air systems of single fuel system and dual fuel system air blast type fuel nozzle assemblies for use in variable geometry (area) combustion systems of advanced design gas turbine engines. The purpose of controlling fuel/air ratios is to meet emission standards over a wide range of engine operating conditions.

Present technology for accomplishing movement of variable area air systems of nozzles and combustors has been through the use of elaborate mechanical linkage systems with imput means through the engine case, such as disclosed in U.S. Pat. No. 3,905,192. U.S. Pat. No. 4,044,533 issued Aug. 30, 1977 to Vaught discloses a variable geometry swirler in a combustion nozzle of a fuel system.

It is an object of this invention to provide a variable area air metering means connected with a pressure responsive actuating means integral within a nozzle assembly for controlling the air flow in the air systems of single fuel system and dual fuel system air blast type fuel nozzle and support assemblies used in gas turbine engines. A further object of the invention is to provide a passage for a pressurized actuating means, either liquid or gas, through the nozzle and support assembly to the inside of the engine case for the purpose of operating the variable area air system of the nozzle and combustor.

DESCRIPTION OF THE PREFERRED EMBODIMENT

Figure 1:
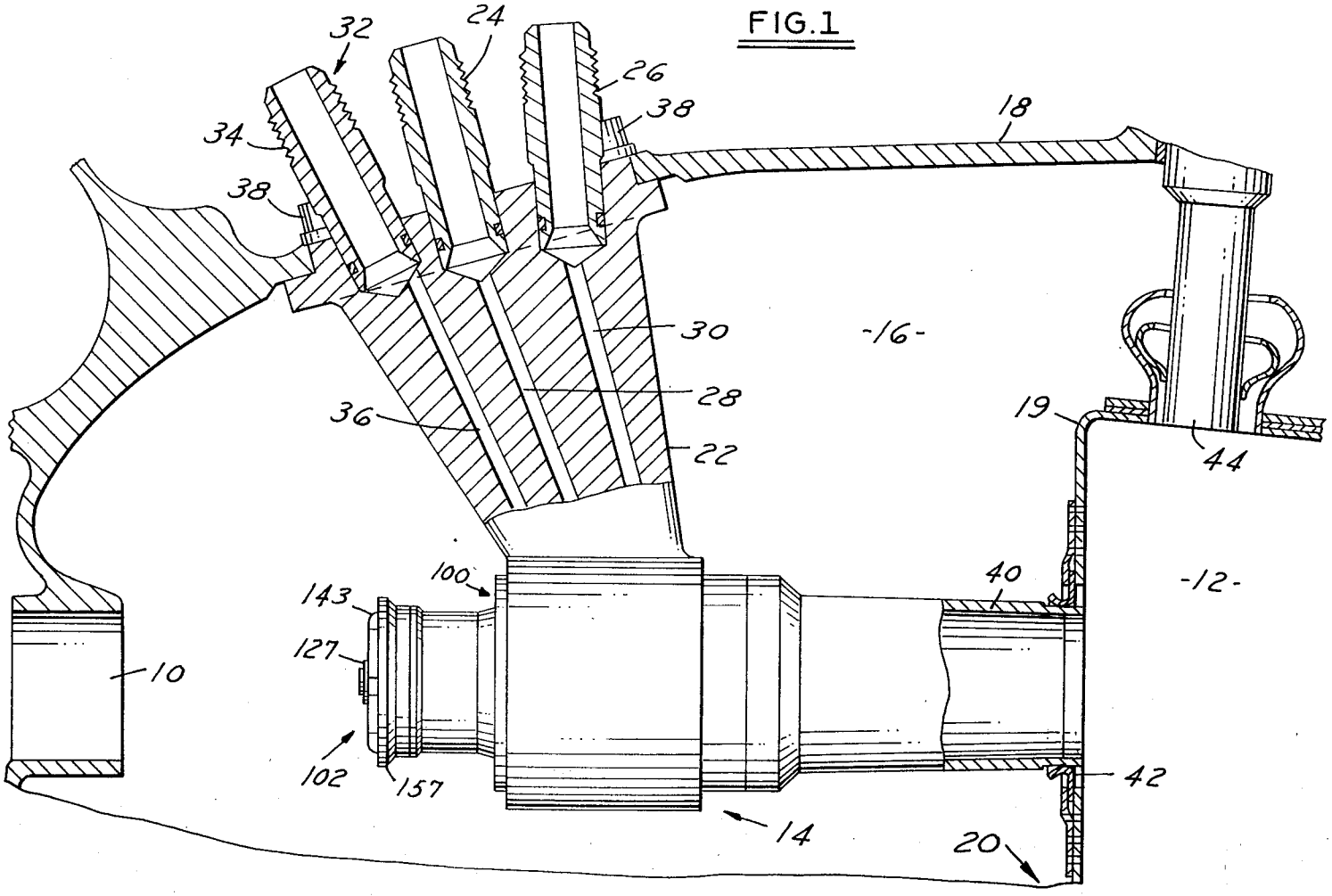
FIG. 1 shows a typical external view of an air blast type fuel nozzle and support assembly with a variable area air system means in the combustion system of a gas turbine engine.

Referring to FIG. 1, the fuel feeding system for the invention disclosed is most particularly adapted for gas turbine engines as indicated by the fragmentary representation thereon. In such engines, air is compressed by compressor and is discharged through an opening 10. A portion of the air enters a combustion chamber 12 for ignition with fuel discharged from nozzles 14. The remainder of the air passes on opposite sides of the combustion chamber 12 through passage 16 defined by the outer engine case 18 and an inner engine case 20 not shown. The products of combustion are discharged from the combustion chamber 12 on to a turbine (not shown) in a known fashion to drive the compressor and to generate a power output such as a propulsive jet force.

The amount of fuel supplied to the nozzle 14 varies for different engine operating conditions. Pressurized fuel is supplied to the nozzle 14 through the support assembly 22 by means of the primary nozzle fuel inlet fitting 24, and the secondary nozzle fuel inlet fitting 26. A primary nozzle fuel passage 28 provides pressurized fuel to the primary fuel system. A secondary nozzle fuel passage 30 provides pressurized fuel to the secondary fuel system. The variable area air system actuating means 32, using either liquid or gas, comprises an inlet fitting 34 and passage 36 to the interior of nozzle 14 in a manner to be herein described.

It is apparent as shown in FIG. 1, the nozzle and support is a unitary assembly and mounted to the outer engine casing 18 by bolts 38, with a typical prechamber 40 at the end of nozzle 14 mounted within an opening 42 of the combustion chamber 12. An engine spark igniter 44 is mounted to the outer engine case 18 and extends through the combustion chamber liner wall 19 to provide ignition in the combustion chamber 12 to the combustible mixture emanating from the nozzle 14.

Figure 2:
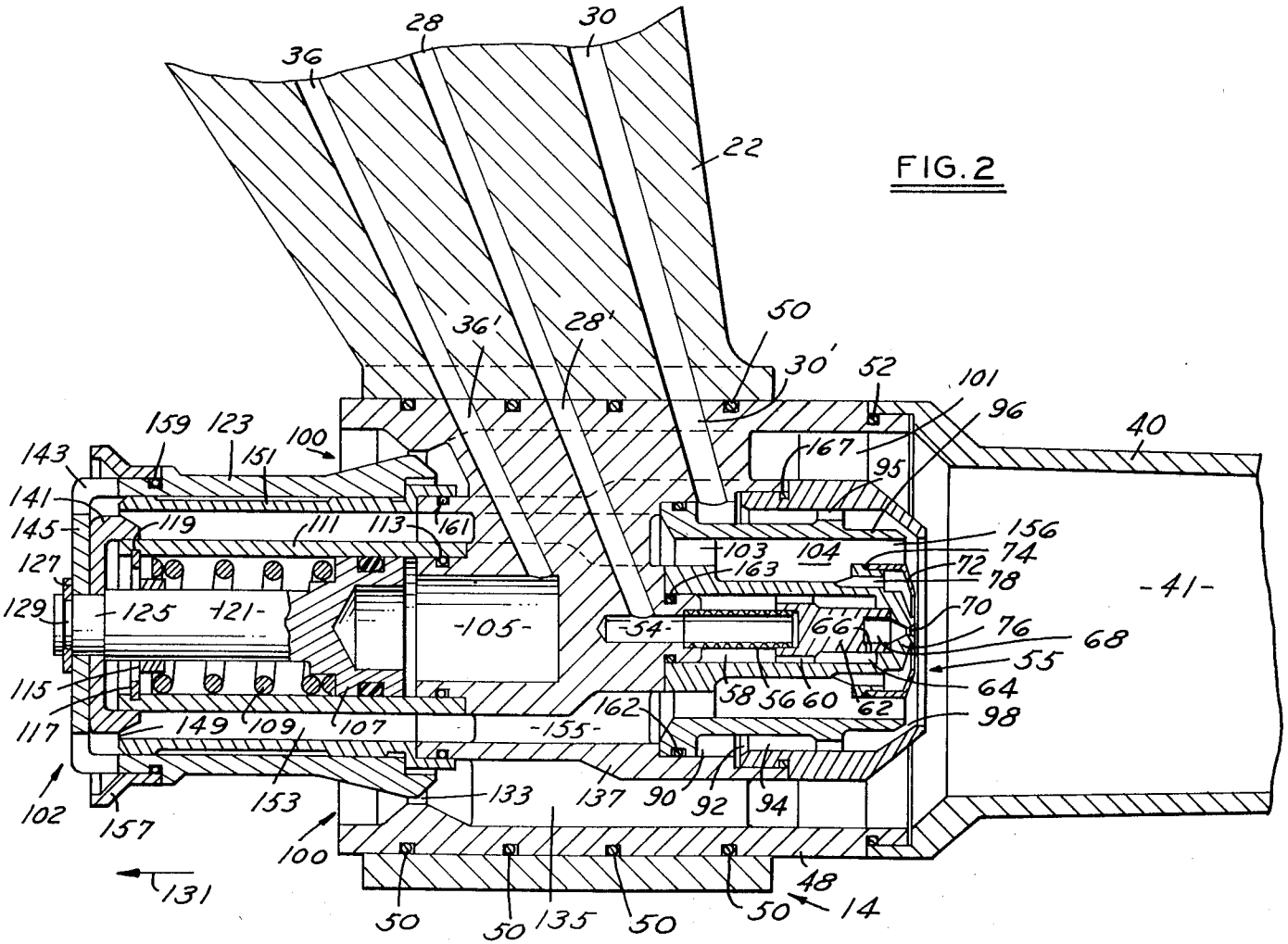
FIG. 2 shows a detail cross-sectional view of a dual fuel system air blast fuel nozzle assembly with a variable area air system means for controlling air flow to both inner and outer air systems of a typical dual fuel system air blast type fuel nozzle assembly.

Referring to FIG. 2, the passages 28, 30 and 36 through the nozzle support 22 are shown in broken cross-section view of the nozzle 14.

The nozzle support 22 is fabricated to the nozzle adaptor or housing 48 by means of brazing rings 50, and the nozzle adaptor 48 is fabricated to the prechamber 40 by brazing ring 52, in a manner to be described hereinafter.

The nozzle adaptor 48 comprises the main body section of the nozzle 14 in that it includes passages 28', 30' and 36' which join the passages 28, 30 and 36 in the nozzle support 22.

The primary nozzle fuel passages 28, 28' extend into a chamber 54, which includes a primary nozzle fuel filter 56. Primary fuel is thus adapted to flow into the primary nozzle means 55 through the fuel filter 56 into a recess 58, through slots 60 of the primary nozzle swirler 62, through recessed area 64 and through the primary nozzle swirl holes 66 into the primary nozzle swirl chamber 68. The primary fuel is discharged through the primary nozzle orifice 70 of the primary nozzle swirl chamber in a hollow cone spray out of the primary nozzle orifice 70.

Around the exit portion of the primary nozzle an air shroud 72 is welded at 74 to the primary nozzle body 76. The primary nozzle body 76 has passages 78 to supply air from the inner air system under the air shroud 72 and washes across the nozzle face to prevent carbon formations on the face of the nozzle.

The secondary nozzle fuel passages 30, 30' extend into an area 90 and is adapted to provide fuel flow through angled secondary swirl slots 92, through area 94, past slots 95 of secondary nozzle swirler 96 and exits through annulus 98.

The outer air system 100 is adapted to exit through outer air swirl vanes or helical slots 101 to prechamber area 41 while the inner air system 102 is adopted to exit through the inner air swirl vanes 103 to prechamber area 41 via chamber 104. The actuating means to control the metering for the outer and inner air systems 100 and 102, respectively comprises, either air, gas, or liquid, through the passages 36 and 36' to control metering of the air to the outer and inner air systems. For example, air is adopted to enter the bore 105 and is adapted to move the piston 107 against the bias of spring 109. That is, the piston 107 is a spring biased pressure responsive valve means. The piston 107 is slidable in the actuating piston sleeve 111 that is fabricated by means of brazing ring 113 to the rear portion of the housing or nozzle adaptor 48. A spring retainer 115 holds the concentricity of the spring in the piston sleeve 111 with a snap ring 117 mounted in recess 119 of the sleeve 111 to hold the actuating piston 107 and spring 109 within the sleeve 111.

The piston is biased against the spring and moves against it. The piston face comprises an effective area, with an operating pressure flowing through the passages 36, 36' operating against the piston 107 which in turn moves two valves which are attached to the piston rod 121. That is, both outer and inner air systems are controlled by the movement of the piston 107. The outer air system metering valve 123 is mounted on to the end 125 of the piston rod 121 and held in place by a retaining ring 127 secured in a recessed portion 129 of the piston rod end 125. The outer air system metering valve 123 and the inner air system metering valve 141 is adapted to move axially or longitudinally as indicated by arrow 131. The opening 133 is adapted to be opened to allow more air to enter the outer air system chamber 135. That is, the outer air system 100 is adapted to flow through the opening 133 through the chamber 135, which is between the body of the nozzle adaptor 48 and the member 137, and is adapted to flow past the outer air swirl vanes 101 to exit into the prechamber area 41. The member 137 separates the outer air system 100 from the inner air system 102. Simultaneous with the movement of air through the outer air system, the inner air system air metering valve 141 is adapted to move to allow air to enter the inner air system chamber 155 via openings 143 in the closed end portion 145 of the outer air system air metering valve 123 and through the opening 149 that exists between the inner air system air metering valve 141 and the end of the outer air system air metering valve sleeve 151. The inner air system 102 thus is adapted to flow through the openings 143 of the outer air system air metering valve 123, past the opening 149 through chambers 153 and 155, past the inner air swirl vanes 103 on the primary nozzle body and through chamber 104 to exit into the prechamber area 41 through annulus 156. An air scoop 157 is fabricated to the air metering valve 123 by means of brazing ring 159 in a manner to be described hereinafter.

It is thus apparent that in the dual fuel system air blast type nozzle having a variable area air system actuating means that the piston is adapted to move both valves; that is, the outer air system air metering valve 123 and the inner air system air metering valve 141 is moved to control the ratio of air in relation to the fuel in the nozzle.

The nozzle and support is a unitary structure in that all the parts are fitted together and brazing rings are placed within the annular recesses of the various members and the completely assembled unit is then placed in a furnace. The elevated temperature in the furnace melts the brazing rods, such as shown in FIG. 2 namely, 50, 113, 161, 162, 163, and 167, to the mating members to form a unitary assembly. A brazing method similar to the method disclosed herein is disclosed in U.S. Pat. No. 3,827,638 issued Aug. 6, 1974 and U.S. Pat. No. 3,871,063 issued Mar. 18, 1975 to Robert M. Halvorsen.

BRIEF DESCRIPTION OF THE MODIFICATIONS

Figure 3:
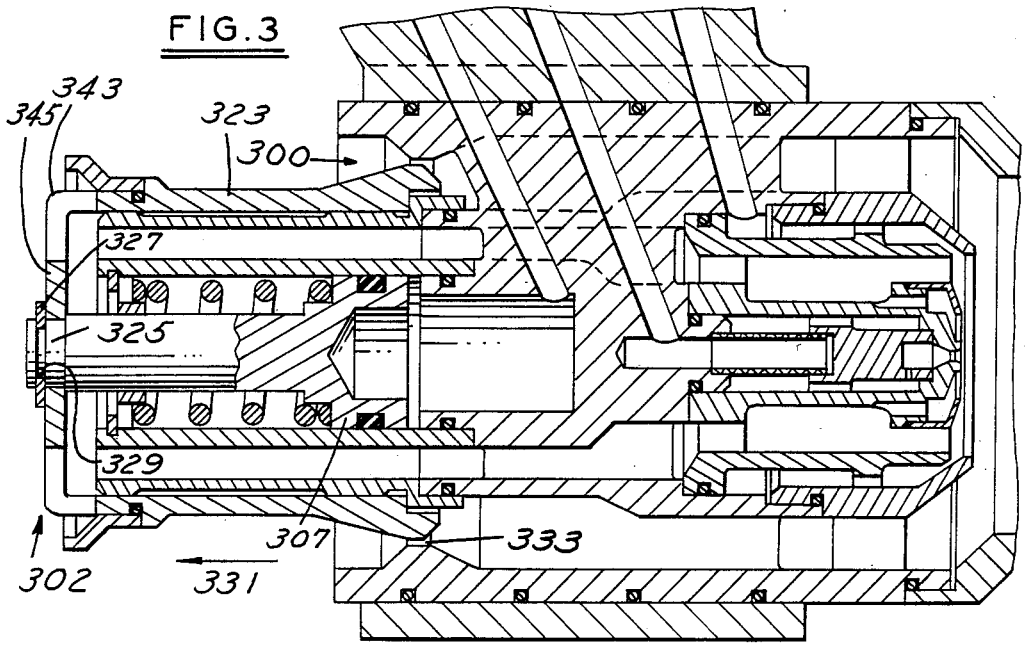
FIG. 3 shows a modification of the nozzle assembly and variable area air system means as shown in FIG. 2 for controlling air flow to the outer air system of applicants' dual system air blast type fuel nozzle assembly.

FIG. 3 shows a modification of the nozzle assembly showing essentially the same elements as in FIG. 2, with the exception of the inner air system air metering valve. That is, movement of the piston 307 longitudinally along the direction of arrow 331 moves the piston rod 325. The outer air metering valve 323 is attached to the end of the piston rod 325 by a retaining ring 327 which is secured thereto in annular recess 329. It is thus apparent that as the pressure in the variable air system actuating means increases, the piston moves axially to allow more air to enter the outer air system 300 through the opening 333, while the inner air system 302 has a constant flow of air through the open vent means 343 of the closed end portion 345 of air metering valve 323.

Figure 4:
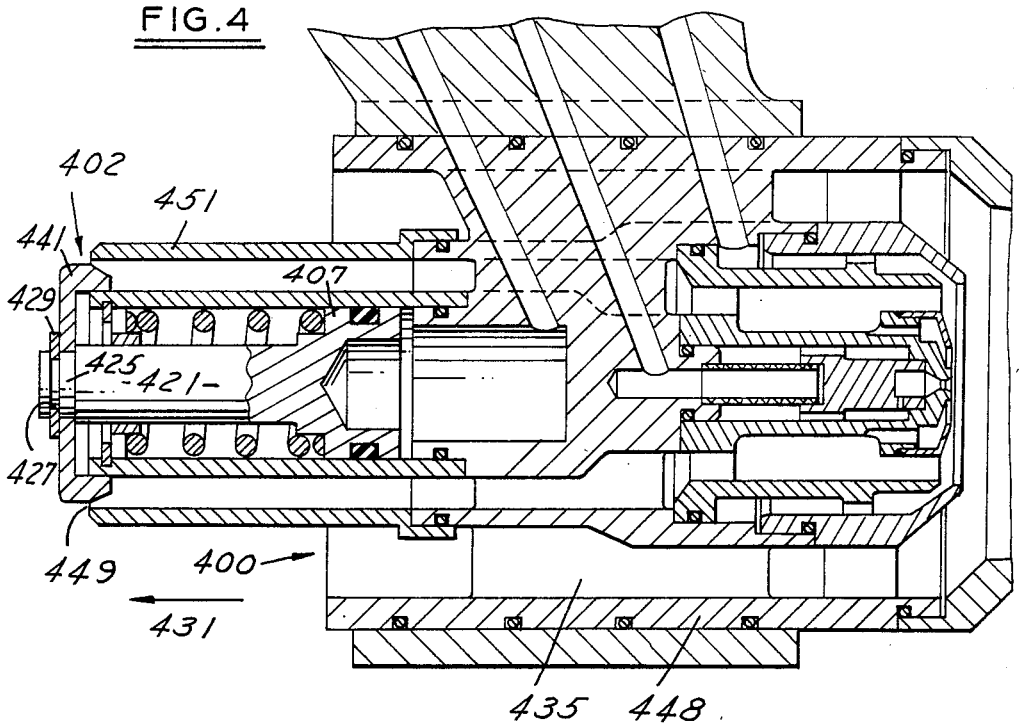
FIG. 4 shows a further modification of the nozzle assembly and variable area air system means as shown in FIG. 2 for controlling air flow to the inner air system of applicants' dual fuel system air blast type fuel nozzle assembly.

FIG. 4 shows a further modification of the nozzle assembly showing a pressure responsive variable area metering means for controlling air flow to the inner air system of a dual fuel system air blast type fuel nozzle assembly. That is, the outer air metering valve is removed and only the inner air system air metering valve is adapted to be moved longitudinally along the direction of arrow 431. As the pressure in the variable area air system actuating means increases, the piston 407 moves axially, moving the inner air system air metering valve 441, allowing more air to enter the inner air system 402 through the opening 449. The air metering valve 441 is connected to the end portion 425 of piston rod 421 by means of a retaining ring 427 sitting in recess 429 of the piston rod. It is apparent that the outer air system 400 is adapted to flow through the chamber 435 of nozzle adaptor 448 without hindrance at a constant flow.

Figure 5:
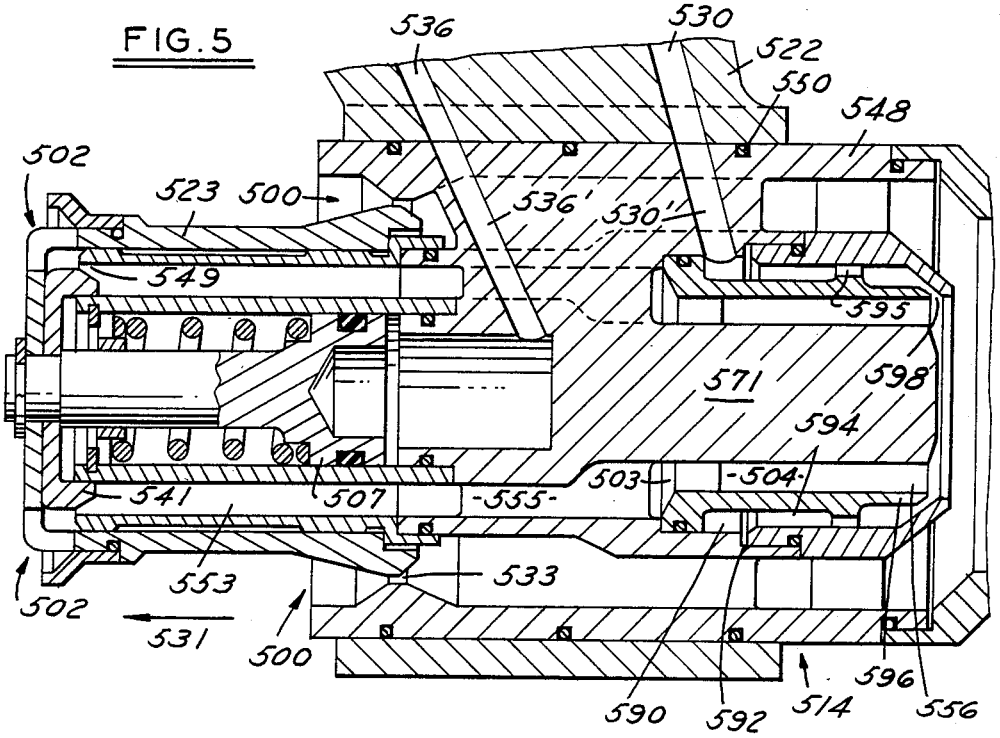
FIG. 5 shows a detail cross-sectional view of a single fuel system air blast type fuel nozzle assembly with a variable area air system means for controlling air flow to both inner and outer air systems of a typical single fuel system air blast type fuel nozzle assembly.

FIG. 5 shows another modification of the nozzle assembly showing a pressure responsive variable area air metering means for controlling air flow to both inner and outer air systems of a typical single fuel system air blast type fuel nozzle assembly. This is evident by the view of FIG. 5 in cross-section showing the deletion of the primary nozzle system, and showing instead a nozzle 514 and support assembly 522 with the fuel passages 530 and 530′ adapted to supply fuel to chamber 590, through angled swirl slots 592, through area 594, past slots 595 of nozzle swirler 596 to exit through annulus 598. Piston 507 is adapted to move longitudinally in the direction of arrow 531 when pressurized through passages 536 and 536′ to move both inner air metering valve 541 and outer air metering valve 523 and allow more air to flow through openings 549 and 533 of the inner and outer air systems 500 and 502 respectively. The inner air system 502 flows through chambers 553, 555, past the inner air swirl vanes 503 through chamber 504 and exits into the prechamber area through annulus 556. The annulus 556 is an opening formed between the core 571 and the orifice of nozzle swirler 596.

Figure 6:
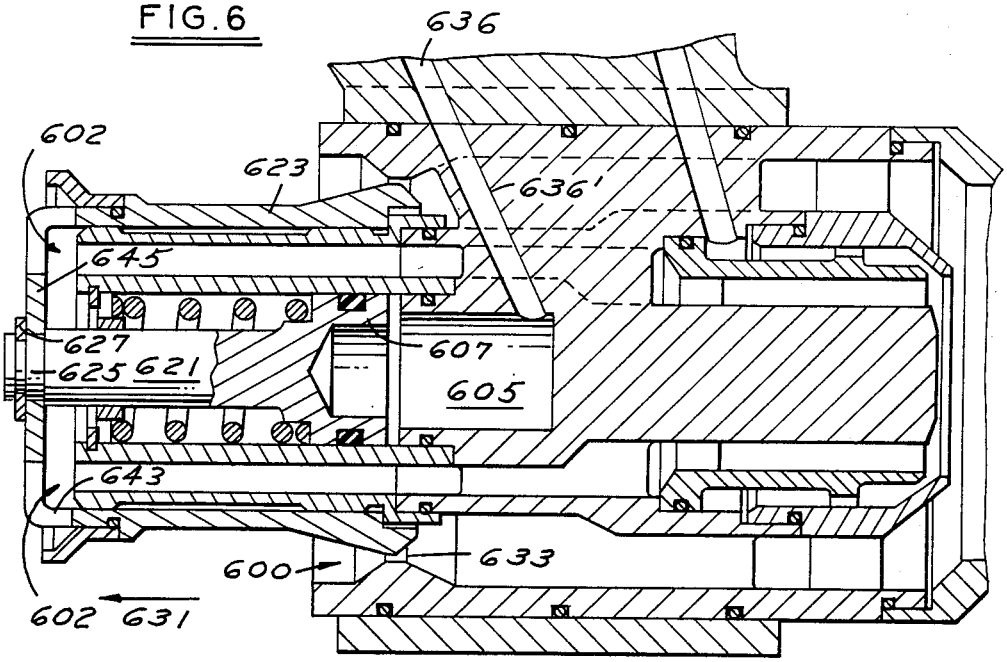
FIG. 6 shows a further modification of the nozzle assembly and variable area air system means as shown for controlling air flow to the outer air system of applicant's single fuel system air blast type fuel nozzle assembly.

FIG. 6 is a further modification of the nozzle assembly showing a pressure responsive variable area air metering means for controlling air flow to the outer air system of a typical single fuel system air blast type fuel nozzle assembly. The single nozzle fuel system shown in FIG. 5 is modified to include the outer air system 600 which is adapted to be moved longitudinally along the direction of arrow 631 by piston 607. The actuating means to control the movement of the metering valve 623 for the outer air system is adapted to flow through passage 636 and 636′ into piston chamber 605 to move piston 607. Movement of piston 607 will effect movement of the outer air metering valve 623 allowing more air to enter through opening 633. The outer air metering valve 623 is connected to the end portion 625 of piston rod 621 by a retaining ring 627. The inner air flow 602 is adapted to be constant.

Figure 7:
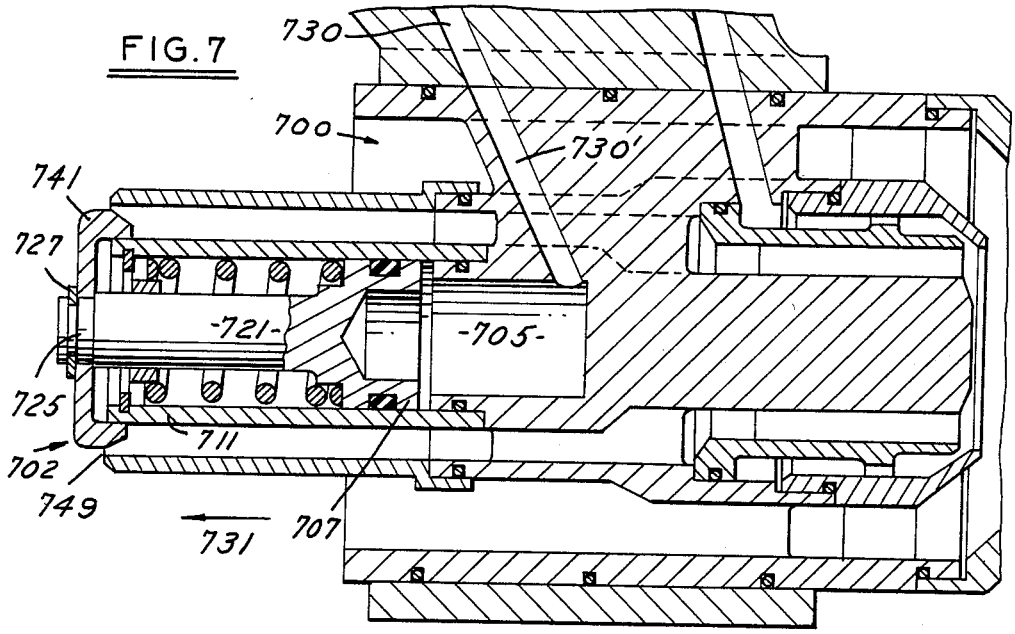
FIG. 7 shows a modification of the nozzle assembly and variable area air system means as shown in FIG. 5 for controlling air flow to the inner air system of applicant's single fuel system air blast type fuel nozzle assembly.

FIG. 7 shows a further modification of the nozzle assembly showing a pressure responsive variable area air metering means for controlling air flow to the inner air system of a typical single fuel system air blast type fuel nozzle assembly. The single system air blast type fuel nozzle shown in FIG. 5 is modified to include the inner air system 702 adapted to flow through opening 749 when the inner air metering valve 741 is moved longitudinally in the direction of arrow 731. The piston 707 is adapted to be moved axially in the piston sleeve 711 by an increase of a pressure medium flowing through passages 730 and 730′ into piston chamber 705. The inner air metering valve 741 is connected to the end portion 725 of piston rod 721 by a retaining ring 727. It is thus apparent that the outer air flow 700 remains constant while the inner air flow 702 is variable.

Figure 8:
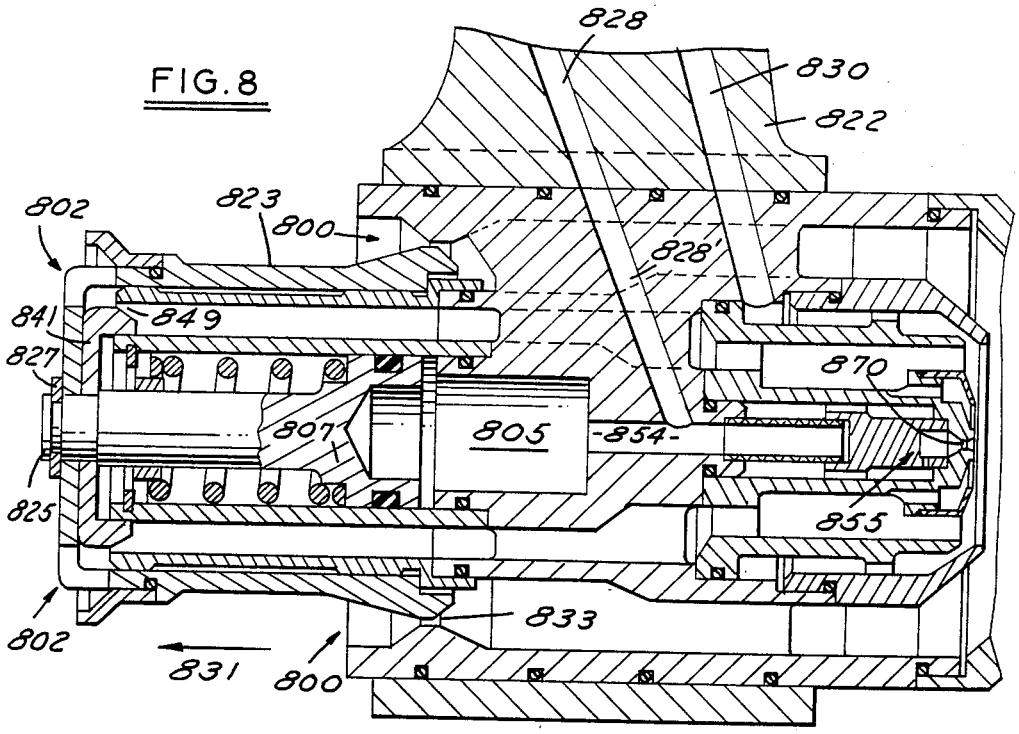
FIG. 8 shows a detail cross-sectional view of a dual fuel system air blast fuel nozzle assembly with a variable area air system means for controlling air flow to both inner and outer air systems of a typical fuel system air blast fuel nozzle assembly with the integral pressure responsive actuating means connected to the primary nozzle fuel passage.

FIG. 8 is a modification of the nozzle assembly shown in FIG. 2, showing a pressure responsive variable area air metering means for controlling outer and inner air flow as a function of the fuel pressure. That is, by increasing the supply of fuel through the primary nozzle passages 828 and 828′ to the chamber 854, the fluid is divided between the piston area chamber 805 and the primary nozzle exit orifice 870 of the primary nozzle means 855. Thus, increasing the fuel pressure in chamber 805 is adapted to move the piston 807 in the direction of arrow 831 and thus simultaneously move the outer air metering valve 823 and the inner air metering valve 841. Movement of the outer and inner air metering valves 823 and 841, allows more air to flow through openings 833 and 849, in the outer and inner air flow systems 800 and 802, respectively.

While the best mode for practicing the invention has been described in detail, and other modes have been described generally in detail, those familiar with the art will recognize various alternative designs and embodiments for practicing the invention as defined by the claims:

What is claimed is:

1. An air blast type fuel nozzle assembly with a variable area air system means useful with a gas turbine engine having engine case means; comprising:
   a. support means connectable to the engine case means and having fluid pressure conduit means;
   b. nozzle means fixedly connected to said support means and having the air supply means internal thereof, said nozzle means including:
      1. an orifice adjacent a downstream discharge end thereof to discharge fuel, and
      2. a pressure responsive variable area air metering means on an upstream end of the nozzle means including an air inlet means on said upstream end in air flow communication with said internal air supply means and sleeve means fixedly disposed on the nozzle means extending upstream thereof for forming a piston-receiving means and a valve means disposed in said air inlet means for controlling air flow entering the nozzle means at said upstream end and flowing through said internal air supply means, said air metering means including piston means slidably received within the sleeve means disposed on the nozzle means with said piston means having a downstream face portion inside the nozzle means for operative connection with a source of actuating fluid pressure through the conduit means of said support means when said assembly is connected to the engine case means and having piston rod means extending upstream of the face portion operatively connected to said valve means for actuating said valve means relative to said air inlet means.

2. An air blast type fuel nozzle assembly, as defined in claim 1, wherein said support means includes a plurality of inlet fittings to provide flow of fluid to said nozzle means, one of which fittings is connected to said conduit means and to a source of fluid pressure.

3. An air blast type fuel nozzle assembly, as defined in claim 1, wherein said nozzle means includes axially extending generally concentric inner air flow means and an outer air flow means and said air metering means includes inner air inlet means and outer air inlet means on said upstream end for the respective air flow means, said valve means including inner and outer valve means in the respective air inlet means on said upstream end.

4. An air blast type fuel nozzle assembly as defined in claim 3, wherein said air metering means comprises:
   a. said sleeve means mounted axially on said upstream end and defining the inner air inlet means therearound and the piston-receiving means therein slidably receiving said piston means;
   b. spring means mounted axially in said piston-receiving means around said piston rod means to maintain bias of said piston;
   c. said valve means connected to said piston rod means on said upstream end thereof and disposed in said inner air inlet means.

5. An air blast type fuel nozzle assembly, as defined in claim 4, wherein said air metering means comprises:
   a. an outer air metering valve sleeve surrounding said sleeve on said upstream end and defining the outer air inlet means therearound;

b. an outer air metering valve in the outer air inlet means provided by said outer air metering valve sleeve and connected to said piston rod;

wherein fuel/air ratios are controlled over a wide range of engine operating conditions.

6. In an air blast type fuel nozzle assembly having fuel supply means including orifice means, air supply means to swirl air with respect to fuel flow from the orifice means, the improvement of a variable area air system means comprising:

(a) nozzle means including a main body having the orifice means adjacent a downstream discharge end and means to provide fuel flow to the orifice means for combustion with said main body having said air supply means internal thereof; and (b) variable area air metering means on the main body upstream of the fuel flow providing means including air inlet means in air flow communication with said internal air supply means to receive air flow for the air supply means and sleeve means fixedly disposed on the main body extending upstream therefrom for forming a piston-receiving means and a valve means in said air inlet means to control air flow entering said air inlet means and flowing through the internal air supply means, said air metering means including piston means slidably disposed within the sleeve means disposed on said nozzle means with said piston means having a downstream face portion inside the nozzle means subject to actuating fluid pressure during operation and having piston rod means extending upstream of the face portion operatively connected to the valve means for actuating the valve means relative to said air inlet means, whereby fuel/air ratio is controllable over a wide range of operating conditions.

7. In the assembly according to claim 6, said nozzle means having a single fuel supply system, said air metering means including first and second valve means and inner and outer air systems to control air flow through the air supply means.

8. In the assembly according to claim 6, said nozzle means having a single fuel supply system, said air metering means including valve means and an outer air system to control air flow through the air supply means.

9. In the assembly according to claim 6, said nozzle means having a single fuel supply system, said air metering means including valve means and an inner air system to control air flow through the air supply means.

10. In the assembly according to claim 6, said nozzle means having a dual fuel supply system, said air metering means including inner and outer valve means and inner and outer air systems to control air flow through the air supply means, said air systems including an inner air inlet means and outer air inlet means upstream of the fuel flow providing means with said inner and outer valve means disposed in a respective one of the inner and outer air inlet means and both said inner and outer valve means being operatively connected to said piston rod means.

11. In the assembly according to claim 6, said nozzle means having a dual fuel supply system, said air metering means including said valve means and an outer air system to control air flow through the air supply means, said air system including an outer air inlet means upstream of the fuel flow providing means around a second sleeve means spaced outwardly around said piston receiving sleeve means with said valve means disposed in said outer air inlet means.

12. In the assembly according to claim 6, said nozzle means having a dual fuel supply system, said air metering means including said valve means and an inner air system to control air flow through the air supply means, said air system including an inner air inlet means upstream of the fuel flow providing means around said piston-receiving sleeve means with said valve means disposed in said inner air inlet means.

13. In the assembly according to claim 6, said nozzle means including means by which fuel flow is divided between the orifice means, and said air metering means including actuating means operable to move valve means of the air metering means.

14. In the assembly according to claim 13, said nozzle means having a dual fuel supply system and said valve means including inner and outer air systems to control air flow through the air supply means.

15. An air blast type fuel nozzle assembly having dual fuel delivery system for a gas turbine engine, comprising nozzle means having housing means with primary fuel supply means for supplying fuel to a primary orifice means adjacent a downstream discharge end of the housing means for combustion and secondary fuel supply means for supplying fuel to a secondary orifice means adjacent said downstream end for combustion and with a primary air supply means for supplying air with respect to fuel flow from the primary orifice means and secondary air supply means for supplying air with respect to fuel flow from the secondary orifice means and further comprising a pressure responsive variable area air metering means on an upstream end of said housing means including a primary air inlet means and a secondary air inlet means on the upstream end to receive air flow and convey same to the respective air supply means and including pressure responsive valve means in said primary and secondary air inlet means on said upstream end to control air flow entering said primary and secondary air supply means, whereby fuel/air ratio is controllable over a wide range of operating conditions.

16. The assembly of claim 15, wherein said pressure responsive air metering means includes a variable area air metering means connected with a pressure responsive actuating means.

* * * * *

UNITED STATES PATENT AND TRADEMARK OFFICE

CERTIFICATE OF CORRECTION

PATENT NO. : 4,562,698

DATED : January 7, 1986

INVENTOR(S) : Robert M. Halvorsen and William F. Helmrich

It is certified that error appears in the above-identified patent and that said Letters Patent are hereby corrected as shown below:

Column 6, claim 1, line 10 which reads "means and having the air supply means internal", should read --means and having air supply means internal--.

Signed and Sealed this

First Day of April 1986

[SEAL]

Attest:

DONALD J. QUIGG

Attesting Officer

Commissioner of Patents and Trademarks